US005897443A

United States Patent [19]

Glaser

[11] Patent Number: 5,897,443

[45] Date of Patent: Apr. 27, 1999

[54] GOLF PRACTICE MAT

[76] Inventor: Paul R. Glaser, 3208 Oleander Dr., Wilmington, N.C. 28403

[21] Appl. No.: 09/031,494

[22] Filed: Feb. 26, 1998

[51] Int. Cl.[6] ..... A63B 69/36

[52] U.S. Cl. ..... 473/279

[58] Field of Search ..... 473/278, 279

[56] References Cited

U.S. PATENT DOCUMENTS

| | | | |
|---|---|---|---|
| 1,594,359 | 8/1926 | Estabrook . | |
| 3,423,096 | 1/1969 | Tone . | |
| 3,712,628 | 1/1973 | Boss | 473/279 |
| 3,869,128 | 3/1975 | Ohashi . | |
| 4,875,685 | 10/1989 | Ballinger | 473/279 X |
| 4,932,663 | 6/1990 | Makar . | |
| 4,955,611 | 9/1990 | Moller . | |
| 5,273,285 | 12/1993 | Long . | |
| 5,356,147 | 10/1994 | MacDonald . | |

*Primary Examiner*—George J. Marlo
*Attorney, Agent, or Firm*—Rhodes, Coats & Bennett, L.L.P.

[57] ABSTRACT

A golf practice device that provides the feel of natural turf is formed of a mat with an insert including a continuous, rotatable belt extending around spaced, parallel rollers to create a moveable horizontal, ball supporting, upper surface. A tray for holding a deformable material is located beneath said belt upper surface, so that striking of the belt upper surface depresses the belt downwardly into engagement with the deformable material while rotating the upper surface of the belt toward the front of the mat to simulate the feel on striking a golf ball on a natural turf or sand surface.

9 Claims, 2 Drawing Sheets

GOLF PRACTICE MAT

BACKGROUND OF THE INVENTION

1. Field of the Invention

The present invention relates generally to an improved golf practice mat for use by golfers in practicing their swing, and in particular to a golf practice mat having a surface that yields under the force of the golf club to provide the feel of natural turf.

2. Description of the Prior Art

Golf practice mats are used at driving ranges as a surface from which a golfer can hit a ball during practice. Conventional golf mats are either in the form of a rubber or synthetic pad, a fabricated mat of joined rubber strips with openings for drainage or, more recently, synthetic or artificial grass or turf mats, such as that sold under the trademark Astroturf. The golfer places the ball directly on the mat, or on a tee inserted into the mat, and then strikes the ball with the golf club.

One of the long-recognized deficiencies with such mats is their lack of resilience, or failure to yield when struck by a golf club. As a result, the resistance incurred by the golfer creates an unnatural feel, lessening the training value of this exercise. In addition, and more seriously, the unyielding impact of the golf club head against the mat can be transferred to the golfer's hands, wrists and arms, causing injury to such areas as the left extensor carpi radialis muscle, the abductor and extensor pollucis muscles and tendon, as well as to the scaphoid-trapzium articulation of the top of the wrist, and to the rotator cuff of the opposite limb.

Various modifications of conventional golf practice mats have been proposed in the prior art, with the expressed intention of addressing this problem. The following patents are illustrative of proposed solutions:

| U.S. Pat. No. | Inventor(s) |
|---|---|
| 1,594,359 | Estabrook |
| 3,423,096 | Tone |
| 3,869,128 | Ohashi |
| 4,932,663 | Makar |
| 4,955,611 | Moller |
| 5,273,285 | Long |
| 5,356,147 | MacDonald |

Evidently, the solutions proposed in the above patents have been less than satisfactory in eliminating the unnatural resistance and thereby achieving a natural feel to the golfer's swing, since the problem continues to exist. A golf practice mat that did overcome this problem would not only be of significant benefit to the golfer in improving his or her swing and reducing the risk of injury, but would be of considerable commercial value.

SUMMARY OF THE INVENTION

The present invention relates to an improved golf practice mat that yields under the impact of a golf club head, creating a feel similar to the feel experienced when a golf club head strikes natural turf during a normal golfing swing.

In general, the golf practice device is comprised of a generally planar mat; and a ball support insert having an upper surface substantially in the plane of the mat. The mat may be of various shapes, but will normally be rectangular. The upper surface of the mat may be of a different material from the upper surface of the ball support insert, but will normally be of the same material to simulate the appearance of a uniform surface.

The ball support insert is comprised of a pair of spaced parallel rollers adapted to freely turn about horizontal, parallel axles or shafts. A continuous, flexible band or belt extends over both rollers to form an elongated belt with a horizontal upper ball support section, and a spaced horizontal lower section. The ends of the shafts are mounted for rotation on spaced, parallel roller support plates on opposite ends of the rollers and parallel to the rotational axis of the flexible belt.

A generally rectangular tray is supported on the roller support plates between the upper and lower horizontal segments of the belt. This tray is designed to hold a deformable material, and includes four sidewalls and a bottom wall. Fitting are provided on the outer surfaces of the tray side walls to join with corresponding fitting on the inner surfaces of the roller support plates to support the tray in the desired position.

Before combining the ball support insert and the mat, the tray is completely or partially filled with a deformable, preferably granular material. For example, the material may be filled with a material such as sand, dirt, crushed marble, urethane foam or foam rubber.

The ball support insert is positioned within a recess in the planar mat so that the horizontal upper surface of the ball support insert is preferably in a plane with the upper surface of the mat. The rotational axis of the belt is parallel to the side of the mat, so that the belt will rotate to the front of the mat when struck by a normal golf swing. Preferably, the outer surface of the insert belt and the upper surface of the mat are of the same material, e.g. artificial turf.

When used, the golfer places a golf ball on the upper surface of the ball support insert, and strikes the ball with the head of a golf club using a normal swing. When the golfer swings the club, the club head will impact the upper surface of the belt behind the ball, as with play on a natural turf, and depress the belt against the deformable material in the tray, allowing the club head to move below the ball. At the same time, the forward momentum of the golf head in frictional engagement with the upper section of the belt, causes the belt upper section to rotate forward, eliminating the unnatural degree of resistance experienced with conventional practice mats.

Importantly, the combination of the belt rotation, and the variable resistance of the engagement of the belt with the deformable material in the tray beneath the belt provides a feel that closely approximates the club feel experienced with natural turf, even when the ball is hit with different force and at a different angle.

Accordingly, one aspect of the present invention is to provide a golf practice device comprised of a mat having a horizontal upper surface, a front edge and a recess; and an insert positioned in the recess, the insert including a pair of spaced parallel rollers and a continuous belt extending around the rollers, the belt having a horizontal, ball supporting, upper section and a rotational axis extending toward the front of the mat, whereby striking of the belt upper section depresses the upper section downwardly and rotates the belt toward the front of the mat.

Another aspect of the present invention is to provide a golf practice device comprised of a mat having a horizontal upper surface, a front edge and a recess; and an insert positioned in the recess, the insert including a pair of spaced parallel rollers; a continuous belt extending around the rollers, the belt having a horizontal, ball supporting, upper section and a rotational axis extending toward the front of the mat; a tray for holding a deformable material beneath the belt upper section; and parallel side plates at opposite ends of the rollers to rotatable support the rollers, and to support the tray beneath the belt upper section, whereby striking of the belt upper section with a golf club head depresses the upper section downwardly into engagement with the deformable material and rotates the upper section of the belt toward the front of the mat.

These and other aspects of the present invention will become apparent to those skilled in the art after a reading of the following description of the preferred embodiment.

DETAILED DESCRIPTION OF THE INVENTION

In the following description, terms such as horizontal, upright, vertical, above, below, beneath, and the like, are used solely for the purpose of clarity in illustrating the invention, and should not be taken as words of limitation. The drawings are for the purpose of illustrating the invention and are not intended to be to scale.

Figure 1:
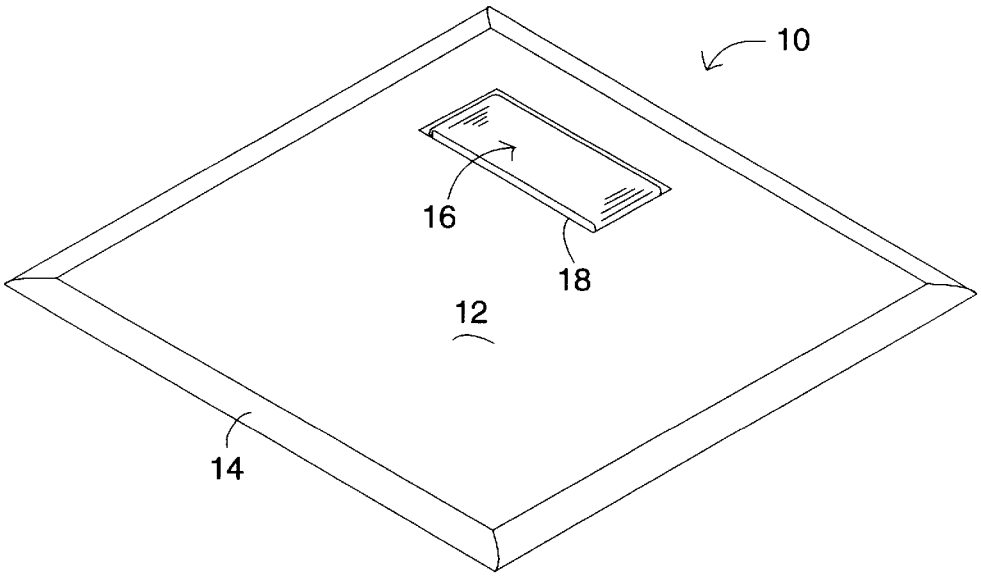
FIG. 1 is a perspective view of the golf practice device.

As illustrated in FIG. 1, the golf practice device, generally 10, is comprised of a horizontal, planar mat 12 formed of artificial turf, surrounded by an outer tapered flexible frame 14. Ball support insert 16 with an upper surface in the plane of mat 12 is shown inserted into recess 18 in mat 12.

Figure 2:
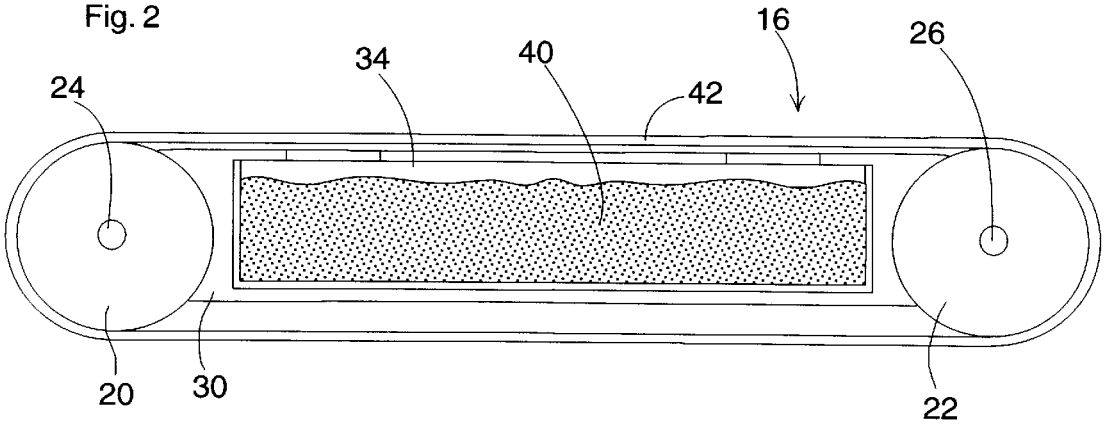
FIG. 2 is a sectional side view of the ball support insert.
Figure 3:
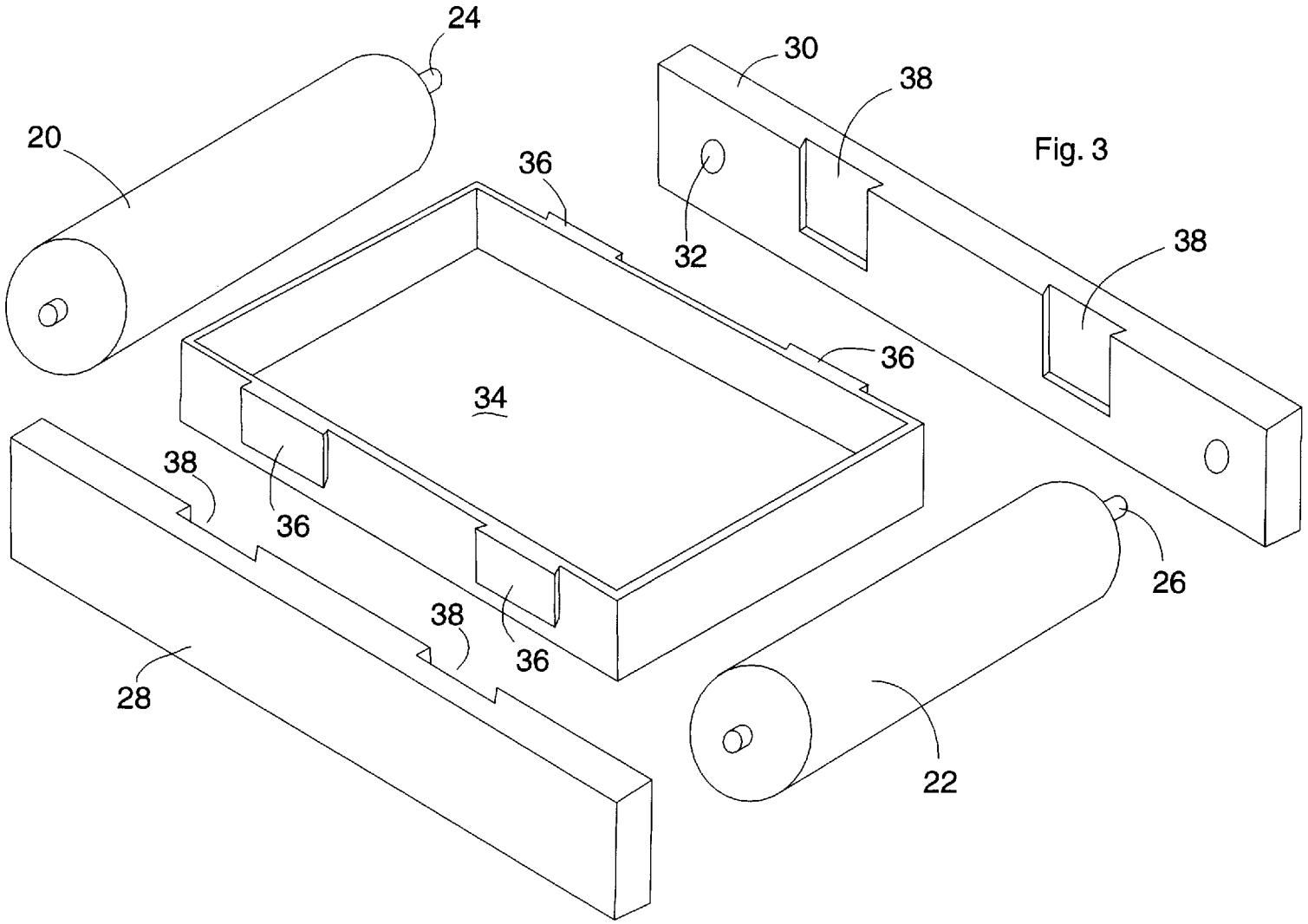
FIG. 3 is an exploded, perspective view of the ball support insert, with the continuous belt removed for ease of illustration.

As best illustrated in FIGS. 2 and 3, ball support insert 16 is comprised of first and second spaced parallel rollers 20 and 22 rotatable on shafts 24 and 26, respectively. Support plates 28 and 30 are positioned perpendicular to roller shafts 24 and 26, and are adapted to support shafts 24 and 26 for rotation. For this purpose, the ends of shafts 24 and 26 are of a circular shape and are adapted to fit into corresponding circular recesses 32 in plates 28 and 30.

Tray 34 is also supported between the rollers 20 and 22 by support plates 28 and 30. Support is achieved with fitting protrusions 36 on the outer side walls of tray 34 that fit in locking engagement into fitting recesses 38 on the inside surfaces of plates 28 and 30. Tray 34 holds a deformable material 40.

Continuous, flexible belt 42 extends around rollers 20 and 22 with tray 34 being positioned between the upper and lower sections of belt 42. Generally, the upper surface of material 40 will be positioned from about 1.0 cm to about 2.0 cm below the upper part of belt 42, so that flexing of the belt under impact with the golf club head will cause the upper belt section to engage material 40.

When a golf ball resting on the upper surface of belt 42 is struck by a golf club head, the upper section of belt 42 will be depressed into engagement with material 40, while at the same time being rotated in a forward direction around rollers 20 and 22. As a result, the feel of the impact to the golfer approximates the club feel experienced with natural turf.

Certain modifications and improvements will occur to those skilled in the art upon a reading of the foregoing description. For example, sensors can be positioned beneath the belt upper surface to detect the golf swing. Such modifications and improvements have been deleted herein for the sake of conciseness and readability but are properly within the scope of the follow claims.

What is claimed is:

1. A golf practice device comprising:

a) a mat having a horizontal upper surface, a front edge and a recess; and b) an insert positioned in said recess, said insert including
- i) first and second spaced, parallel side plates;
- ii) a pair of spaced parallel rollers rotatably supported on said side plates;
- iii) a continuous belt extending around said rollers, said belt having a horizontal, ball supporting, upper section and a rotational axis extending toward the front of said mat; and
- iii) a tray for holding a deformable material secured to said side plates and spaced beneath said belt upper section, whereby striking of said belt upper section with a golf club depresses said upper section downwardly into engagement with said deformable material and rotates said belt toward the front of said mat.

2. The device of claim 1, wherein said belt has an outer surface formed of artificial turf.

3. The device of claim 1, wherein said tray and said plates include locking fittings to attach said tray to said plates.

4. The device of claim 1, wherein said rollers include parallel shafts with opposed ends, and said plates include recesses to receive said shaft ends.

5. The device of claim 1, wherein said deformable material is a granular material selected from the group consisting of sand, dirt, crushed marble, urethane foam and foam rubber.

6. The device of claim 1, wherein said tray is positioned to hold said deformable material about 1.0 cm to about 2.0 cm below said belt upper section.

7. A golf practice device comprising:

a) a mat having a horizontal upper surface, a front edge and a recess; and b) an insert positioned in said recess, said insert including
- i) first and second spaced, parallel side plates;
- ii) a pair of spaced parallel rollers rotatably supported on said side plates;
- iii) a continuous belt extending around said rollers, said belt having a horizontal, ball supporting, upper section and a rotational axis extending toward the front of said mat;
- iii) a tray secured to said side plates and spaced beneath said belt upper section; and
- iv) deformable material in said tray, said deformable material having an upper surface spaced below said belt upper section, whereby striking of said belt upper section with a golf club depresses said upper section downwardly into engagement with said deformable material and rotates said belt toward the front of said mat.

8. The device of claim 7, wherein said deformable material is a granular material selected from the group consisting of sand, dirt, crushed marble, urethane foam and foam rubber.

9. The device of claim 7, wherein the upper surface of said deformable material is about 1.0 cm to about 2.0 cm below said belt upper section.

* * * * *